US007156388B2

(12) United States Patent
Kang et al.

(10) Patent No.: US 7,156,388 B2
(45) Date of Patent: Jan. 2, 2007

(54) INKJET PRINTER AND PAPER FEEDING METHOD THEREFOR

(75) Inventors: Sung-wook Kang, Seoul (KR); Seuk-jin Yun, Anyang-si (KR); Won-kil Chang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 321 days.

(21) Appl. No.: 10/917,523

(22) Filed: Aug. 13, 2004

(65) Prior Publication Data

US 2005/0082742 A1 Apr. 21, 2005

(30) Foreign Application Priority Data

Aug. 13, 2003 (KR) ..... 10-2003-0056006
Aug. 18, 2003 (KR) ..... 10-2003-0056856

(51) Int. Cl.
*B65H 7/08* (2006.01)
*B65H 3/52* (2006.01)

(52) U.S. Cl. ..... 271/110; 271/167; 271/121

(58) Field of Classification Search ..... 271/121, 271/122, 124, 110, 167
See application file for complete search history.

(56) References Cited

U.S. PATENT DOCUMENTS

2003/0107780 A1* 6/2003 Kang et al. ..... 358/498
2004/0245703 A1* 12/2004 Yun et al. ..... 271/110
2005/0051945 A1* 3/2005 Kang ..... 271/121

FOREIGN PATENT DOCUMENTS

JP 6-1493 1/1994
JP 8-174931 7/1996
JP 9-71016 3/1997
JP 11-334935 12/1999

* cited by examiner

*Primary Examiner*—Patrick Mackey
*Assistant Examiner*—Kaitlin Joerger
(74) *Attorney, Agent, or Firm*—Staas & Halsey LLP

(57) ABSTRACT

An inkjet printer includes a resistance element with which a front end of the paper becomes in contact so that a paper on a top of the stack of papers is separated from the stack of papers and picked up from a cassette, an angle conversion unit which changes an inclination angle of the resistance element with respect to the front end of the paper, and a switching gear which is moved by a carriage to a first position to feed the paper and to a second position to drive the angle conversion unit.

22 Claims, 13 Drawing Sheets

INKJET PRINTER AND PAPER FEEDING METHOD THEREFOR

CROSS-REFERENCE TO RELATED APPLICATIONS

This application claims the priority of Korean Patent Applications No. 2003-56006, filed on Aug. 13, 2003, and No. 2003-56856, filed on Aug. 18, 2003, in the Korean Intellectual Property Office, the disclosures of which are incorporated herein by reference.

BACKGROUND OF THE INVENTION

1. Field of the Invention

The present invention relates to an inkjet printer and a paper feeding method, and, more particularly, to an inkjet printer which picks up papers one by one from a cassette and moves the paper to a printing unit that prints an image on the paper, and a paper feeding method therefor.

2. Description of the Related Art

Generally, an inkjet printer picks up a single paper from a cassette containing a stack of paper and moves the paper. A single paper is separated from a stack of paper and picked up using a friction or a stiffness of the paper.

FIG. 1 illustrates a method of picking up a single paper using a stiffness of the paper. Referring to FIG. 1, a cassette 51 contains a paper stack P. A pickup roller 52 is placed on the paper stack P to be in close contact with and press the paper stack P. A resistance element 53 is obliquely placed in front of the paper stack P at an inclination angle A with respect to the front of the paper stack P. When the pickup roller 52 rotates, papers are moved. Here, two or more papers are usually moved due to a frictional force between the papers. A frictional force between the pickup roller 52 and the paper stack P is greater than a frictional force between papers in the paper stack P. Accordingly, when papers contact the resistance element 53, only a paper P1 that is in contact with the pickup roller 52 on a top of the paper stack P slips over a paper therebelow and is curved at its front portion meeting the resistance element 53, thereby having a curl, as denoted by a reference character C1. Thereafter, with rotation of the pickup roller 52, the curl becomes greater as denoted by a reference character C2, and the curl is suddenly straightened as denoted by a reference character C3 due to a stiffness of the paper P1, so that only the paper P1 is separated from the paper stack P and fed.

The inclination angle A of the resistance element 53 is set to be suitable to widely used plain papers. Accordingly, when a thick paper having a large stiffness is used, a separation procedure denoted by C1, C2, and C3 may be never performed or may be incompletely performed after a front end of the thick paper reaches the resistance element 53. As a result, a pickup error, in which more than one paper or no paper is fed, occurs. In addition, a driving motor (not shown) to drive the pickup roller 52 may be overloaded.

To overcome this problem, increasing the inclination angle A of the resistance element 53 is necessary. Referring to FIG. 2, the resistance element 53 is rotatably installed and is elastically biased by a spring 54. When a thick paper P1 having a large stiffness is moved, the resistance element 53 rotates in a direction B so that a load on the driving motor (not shown) is decreased and the separation procedure denoted by C1, C2, C3 is performed. However, such a structure allows the inclination angle A to be slightly changed even for the plain paper, which may cause double feeding.

FIG. 3 schematically illustrates a paper feed path of a conventional inkjet printer. Referring to FIG. 3, a paper P is picked up from a cassette 51 by a pickup roller 52 and is inserted into a feed roller 63 via a drive roller 62. The feed roller 63 feeds the paper P according to a print speed of a printing unit 64. Reference numeral 66 denotes a first paper detector which detects a front end of the paper P. When the paper P is not detected by the first paper detector 66 within a predetermined time, a paper jam is determined to have occurred between the cassette 51 and the first paper detector 66. Reference numeral 67 denotes a second paper detector which detects the front end of the paper P fed by the feed roller 63. The second paper detector 67 is provided to adjust a print start time of the printing unit 64. When the paper P is not detected by the second paper detector 67 within a predetermined time since detection of the paper P by the first paper detector 66, a paper jam is determined to have occurred between the first and second paper detectors 66 and 67.

To feed the paper P without a skew, registration is performed between the first paper detector 66 and the feed roller 63. After the front end of the paper P is detected by the first paper detector 66, the paper P is moved slightly further than a distance between the first paper detector 66 and the feed roller 63. Here, the feed roller 63 rotates in a direction opposite to a paper feed direction or does not rotate. Then, due to a stiffness of the paper P, a front portion of the paper P is curved as expressed by a dotted line, and the front end of the paper P is aligned with the feed roller 63.

As described above, a mis-feed of the paper P occurring between the first and second paper detectors 66 and 67 can be determined based on whether the paper P is detected by the second paper detector 67 within the predetermined time since the paper P was detected by the first paper detector 66. During registration, when the paper P is fed only to a position X shown in FIG. 3 due to a mis-feed, the front end of the paper P is not detected by the second paper detector 67 within the predetermined time, and thus, a paper jam is determined. However, even when the paper P is not in state expressed by the dotted curve in FIG. 3, if only the front end of the paper P becomes in contact with the feed roller 63, the second paper detector 67 detects the paper P within the predetermined time. As a result, the paper jam is not determined, and printing unit 64 prints an image onto the paper. In this situation, since the front end of the paper P is not exactly aligned with the feed roller 63, that is, since a registration error occurs, a skew of the paper may not be detected.

SUMMARY OF THE INVENTION

The present invention provides an improved printer capable of reliably feeding plain papers and thicker papers having a larger stiffness than the plain papers one by one, and a paper feeding method therefor.

The present invention also provides a printer which is capable of efficiently processing a paper jam by detecting a registration error and repeating registration to correct the registration error, and a paper feeding method therefor.

According to an aspect of the present invention, an inkjet printer comprises a pickup roller which picks up a paper from a cassette in which a plurality of papers are stacked, a resistance element to contact with a front end of the paper so that a paper on a top of the stack of papers is separated from the stack of papers and picked up from the cassette, a feed roller which feeds the paper, an angle conversion unit which changes an inclination angle of the resistance element with respect to the front end of the paper, and a switching gear which is moved by a carriage to a first place to feed the paper and to a second place to drive the angle conversion unit.

According to another aspect of the present invention, a paper feed method for an inkjet printer including a cassette to contain a stack of papers, a resistance element to separate a paper on a top of the stack of papers from the stack using a stiffness of the paper, an angle conversion unit to change an inclination angle of the resistance element with respect to a front end of the paper, a feed roller and a pickup roller driven by a driving motor, and an encoder to generate a count proportional to a rotation amount of the feed roller and the pickup roller, comprises picking up a paper from the cassette by rotating the pickup roller, and when the front end of the paper is not detected by a first paper detector within a predetermined time, repeating the pickup operation after changing an inclination angle of the resistance element to be greater than an initial inclination angle by driving the angle conversion unit.

The paper feed method further comprises changing the inclination angle of the resistance element to be suitable to the paper by driving the angle conversion unit according to paper information transmitted from a host computer, before picking up the paper.

The paper feed method further comprises performing a first registration by moving the front end of the paper by a first registration amount greater than a distance between the first paper detector and the feed roller after the front end of the paper picked up from the cassette is detected by the first paper detector, thereby aligning the front end of the paper with the feed roller; and when a first error occurs due to a stall of the driving motor during the first registration, repeating the first registration by calculating a mis-feed amount of the paper using a difference between a current number of counts generated by the encoder and a target number of counts obtained from the first registration amount and moving the paper by at least the mis-feed amount.

The paper feed method further comprises performing a second registration by detecting the front end of the paper using a second paper detector located at an output side of the feed roller and adjusting a print start time of a printing unit, which prints an image onto the paper.

The paper feed method further comprises discharging the paper by moving the paper until a rear end of the paper is detected by the first paper detector when a second error occurs during the second registration since the front end of the paper is not detected by the second paper detector within a predetermined time.

According to still another aspect of the present invention, a paper feed method for an inkjet printer including a cassette to contain a stack of papers, a resistance element to separate a paper on a top of the stack of papers from the stack using a stiffness of the paper, an angle conversion unit to change an inclination angle of the resistance element with respect to a front end of the paper, a feed roller and a pickup roller driven by a driving motor, and an encoder to generate a count proportional to a rotation amount of the feed roller and the pickup roller, comprises changing the inclination angle of the resistance element to be suitable to a paper according to paper information transmitted from a host computer; picking up the paper from the cassette by rotating the pickup roller; and when a current limit error occurs since current of the driving motor exceeds a predetermined limit current value during the pickup operation and/or when a counting error occurs since a counting interval of the encoder exceeds a predetermined time interval during the pickup operation, repeating the pickup operation after changing the inclination angle of the resistance element to be greater than an initial inclination angle by driving the angle conversion unit.

The paper feed method further comprises performing a first registration by moving the front end of the paper by a first registration amount greater than a distance between the first paper detector and the feed roller after the front end of the paper is detected by the first paper detector, thereby aligning the front end of the paper with the feed roller; and when a first error occurs due to a stall of the driving motor during the first registration, repeating the first registration by calculating a mis-feed amount of the paper using a difference between a current number of counts generated by the encoder and a target number of counts obtained from the first registration amount and moving the paper by at least the mis-feed amount.

The paper feed method further comprises performing a second registration by detecting the front end of the paper using a second paper detector located at an output side of the feed roller and adjusting a print start time of a printing unit, which prints an image onto the paper; and discharging the paper by moving the paper until a rear end of the paper is detected by the first paper detector when a second error occurs during the second registration since the front end of the paper is not detected by the second paper detector within a predetermined time.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
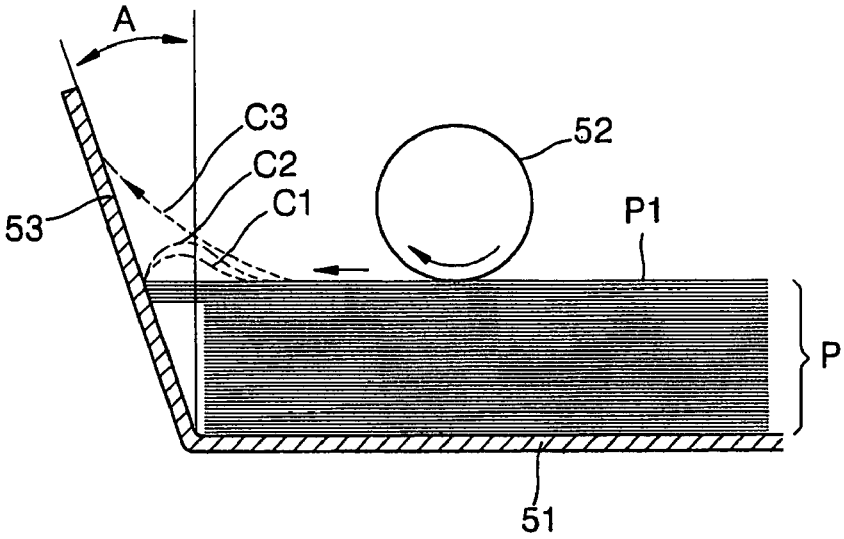
FIG. 1 (PRIOR ART)
FIG. 1 is a cross-sectional view illustrating a conventional method of picking up a single paper using a stiffness of the paper.
Figure 2:
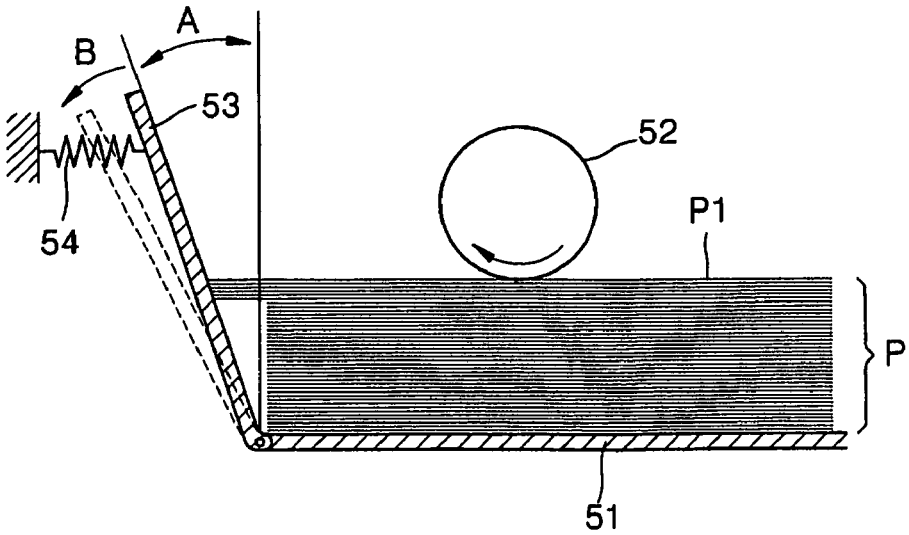
FIG. 2 (PRIOR ART)
FIG. 2 is a cross-sectional view illustrating another conventional method using a stiffness of the paper.
Figure 3:
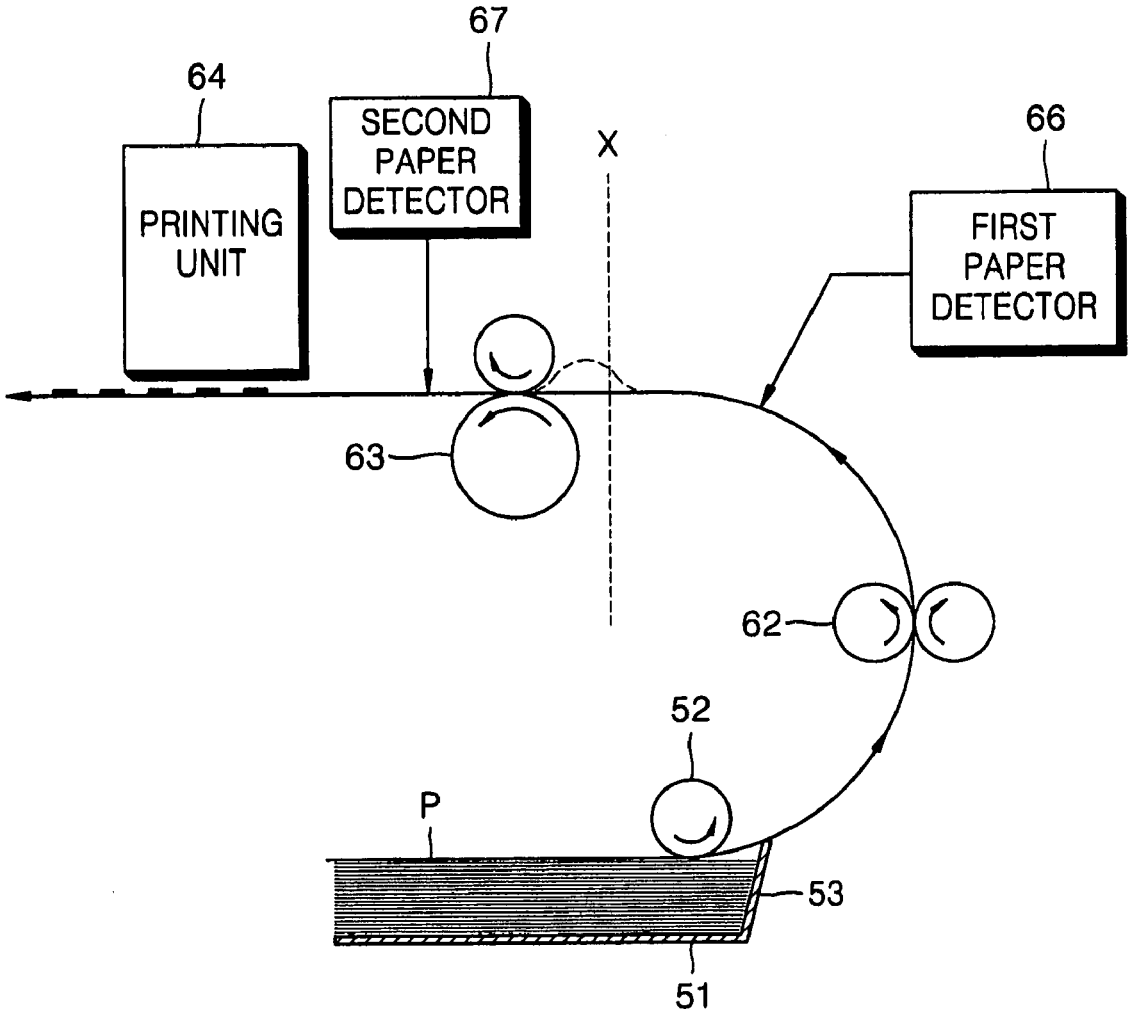
FIG. 3 (PRIOR ART)
FIG. 3 is a schematic diagram of a paper feed path of a conventional printer.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 4:
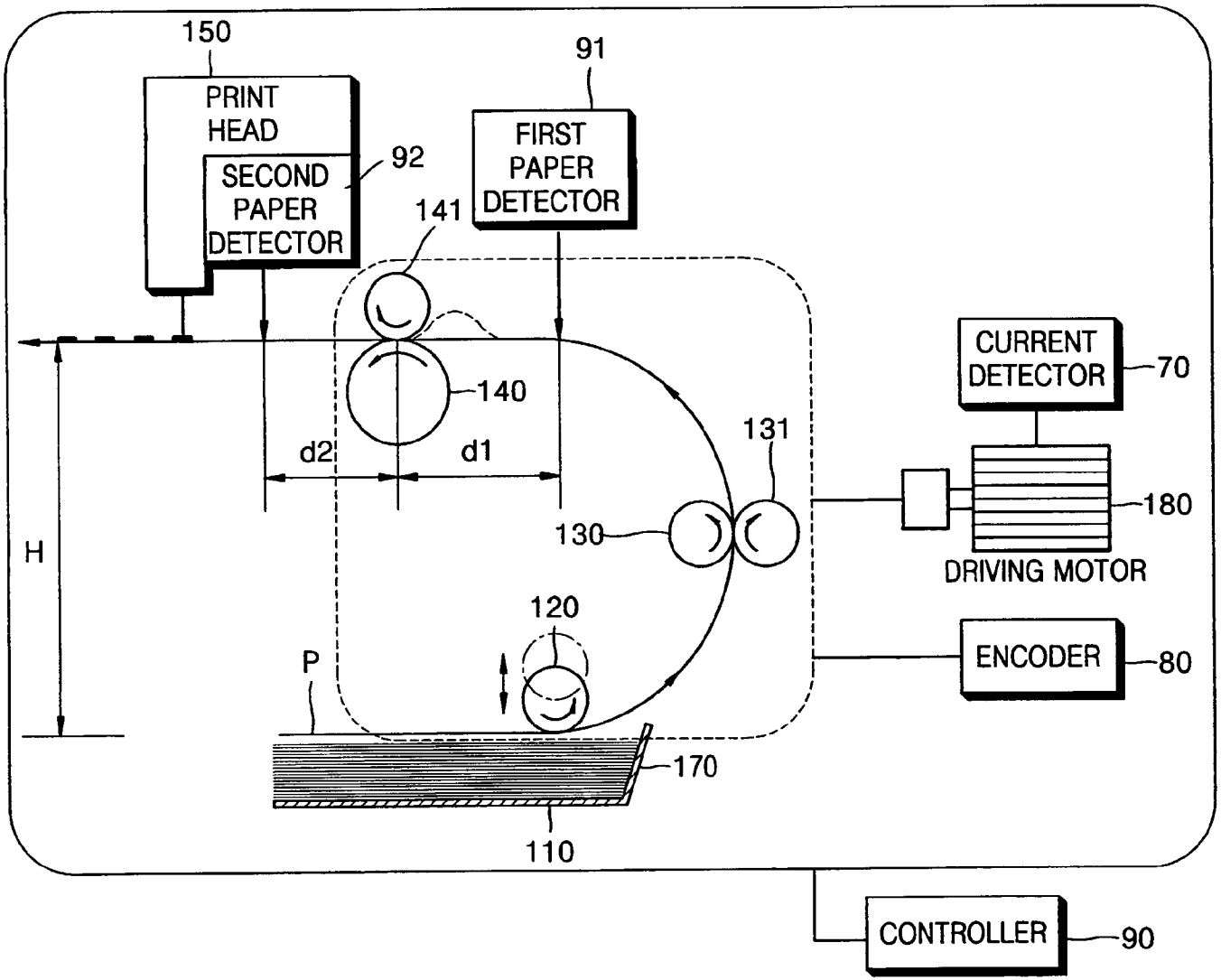
FIG. 4 is a schematic diagram of an inkjet printer according to an embodiment of the present invention.

FIG. 4 is a schematic diagram of an inkjet printer according to an embodiment of the present invention. The inkjet printer includes a cassette 110 containing a stack of papers P, a pickup roller 120 picking up the papers one by one from the cassette 110, and a feed roller 140 and a driven roller 141 which rotate together in contact with each other and feed a paper P at a predetermined speed. Reference numeral 130 denotes a drive roller which assists in feeding the paper P between the pickup roller 120 and the feed roller 140. The pickup roller 120 rotates while pressing the stack of papers P contained in the cassette 110 so as to pick up a paper P. After completing a paper pickup operation, the pickup roller 120 is separated from the stack of papers P. The driven roller 141 is in close contact with the feed roller 140. A driven roller 131 is in close contact with the drive roller 130. Reference numeral 170 denotes a resistance element to separate a single paper P from the stack of papers P using a stiffness of the paper P. Reference numeral 150 denotes a print head, i.e., an example of a printing unit, which prints an image by ejecting ink onto the paper P. The print head 150 is mounted on a carriage (151 shown in FIG. 5) moved back and forth in a direction perpendicular to a paper feed direction. A driving motor 180 drives the pickup roller 120, the drive roller 130, and the feed roller 140. Reference numeral 70 denotes a current detector which detects a driving current of the driving motor 180. Reference numeral 80 denotes an encoder which generates a count proportional to a rotation amount of the feed roller 140 and the pickup roller 120. Reference numerals 91 and 92 respectively denote a first paper detector and a second paper detector, which detect the paper P before and after the feed roller 140. Reference numeral 90 denotes a controller which controls a paper feed procedure and a print procedure of the inkjet printer.

Figure 5:
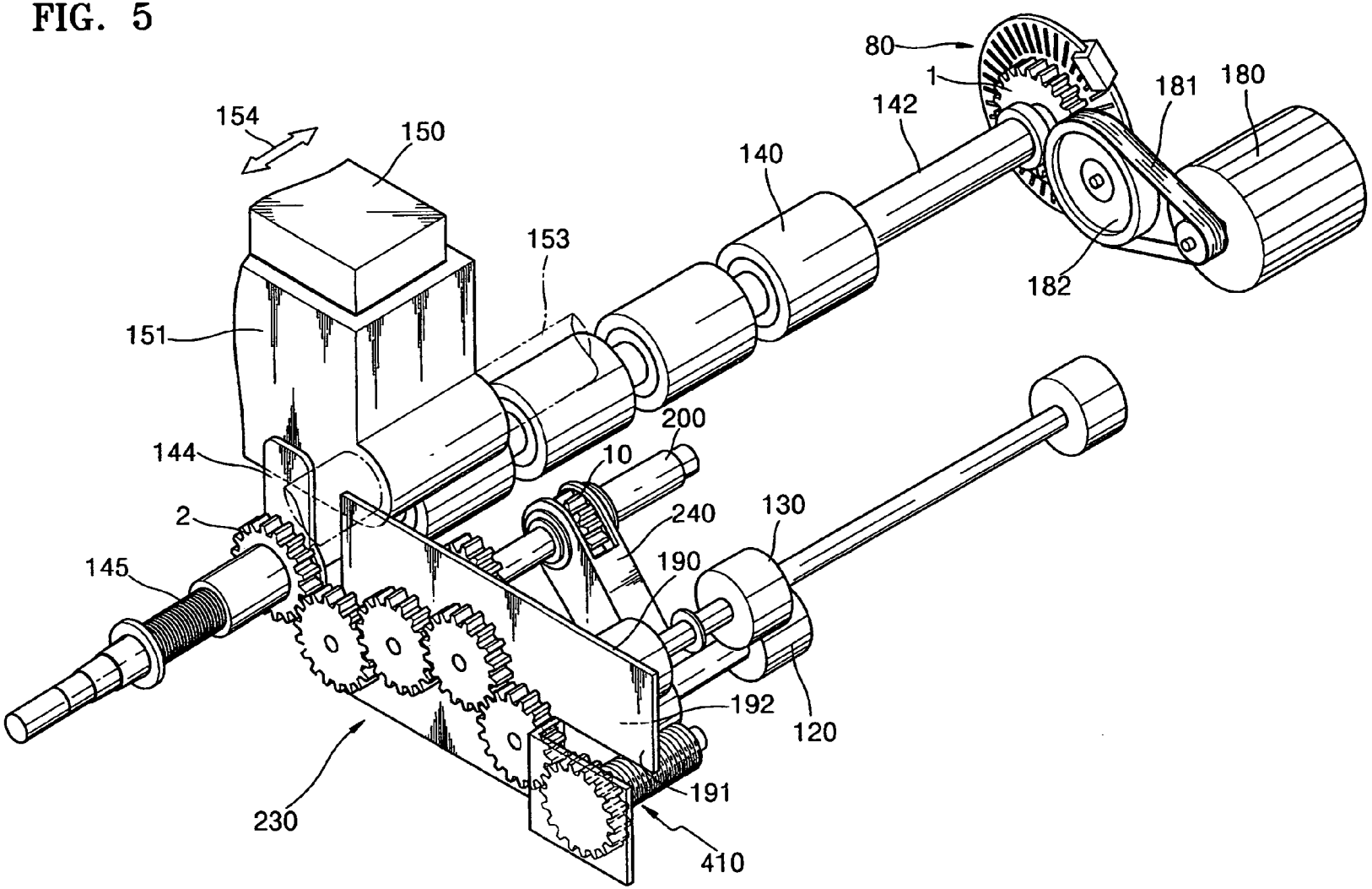
FIG. 5 is a perspective view of a paper feed system according to an embodiment of the present invention.

FIG. 5 is a perspective view of a paper feed system of the inkjet printer shown in FIG. 4. Referring to FIG. 5, a first gear 1 and the encoder 80 are coupled to an end of a shaft 142 of the feed roller 140. The driving motor 180 is connected to the gear 1 through a belt 181 and a pulley 182 and rotates the feed roller 140. A switching lever 144 and a switching gear 2 are sequentially coupled to the other end of the shaft 142 of the feed roller 140. The switching gear 2 is elastically biased toward the switching lever 144 by a compression spring 145.

Figure 6:
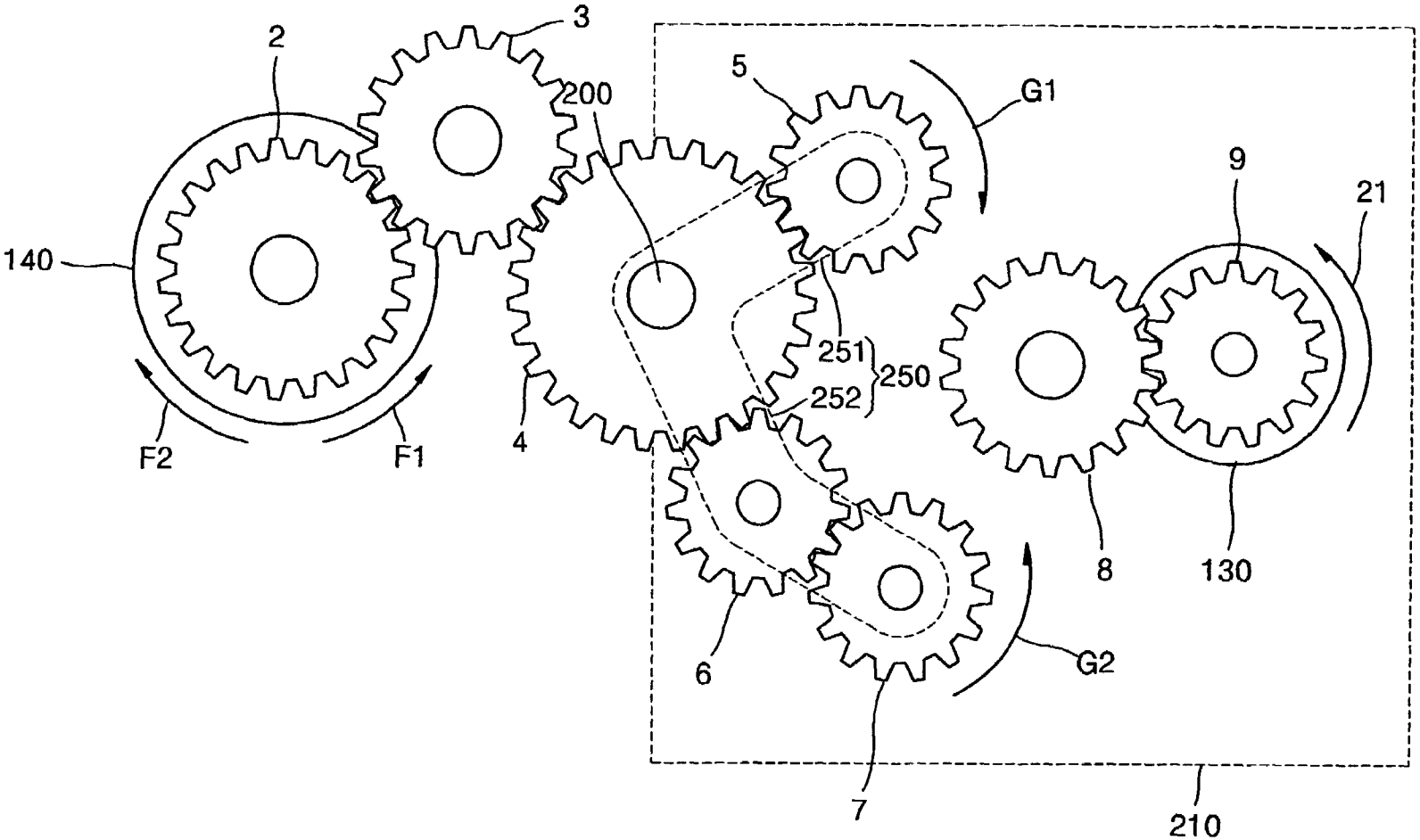
FIG. 6 is a detailed diagram of a first gear train according to the embodiment of FIG. 5.
Figure 7:
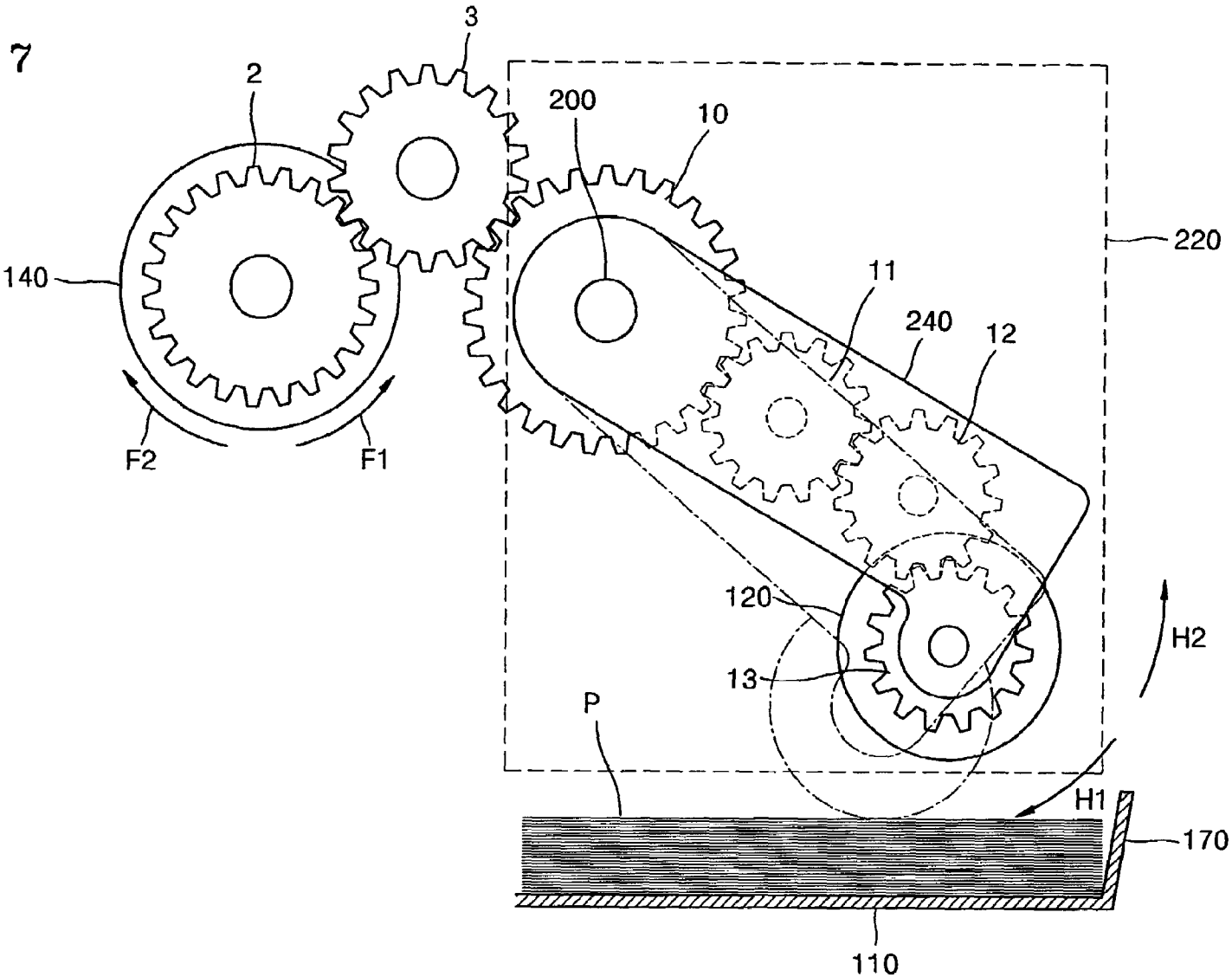
FIG. 7 is a detailed diagram of a second gear train according to the embodiment of FIG. 5.

A pickup shaft 200 is installed at a bracket 190. A gear 3 to engage with the switching gear 2 and a first gear train 210 to drive the drive roller 130 are provided at an inside 192 of the bracket 190, as shown in FIG. 6. A pickup arm 240 is rotatably installed at the pickup shaft 200. The pickup roller 120 and a second gear train 220 shown in FIG. 7 are installed at the pickup arm 240. A third gear train 230 to drive a rotating element 410 is provided at an outside 191 of the bracket 190.

A carriage 151 is moved by a carriage motor (not shown) in a direction 154 along a shaft 153. The carriage 151 moves in a first moving direction to print and in a second moving direction to move the switching gear 2. While the carriage 151 is moved back and forth in the first moving direction, the switching gear 2 is elastically biased by the compression spring 145 so that the switching gear 2 is positioned at a first place where the switching gear 2 is connected to the first and second gear trains 210 and 220 to drive the pickup roller 120 and the drive roller 130. When the carriage 151 is moved to the second moving direction and presses the switching lever 144, the switching gear 2 is positioned at a second place where the switching gear 2 is connected to the third gear train 230 to rotate the rotating element 410.

FIG. 6 is a detailed diagram of the first gear train 210. Referring to FIG. 6, a gear 4 engaging with the gear 3 is coupled to the pickup shaft 200. In addition, a swing bracket 250 including a first arm 251 and a second arm 252 is rotatably coupled to the pickup shaft 200. A gear 5 is coupled to the first arm 251. Gears 6 and 7 engaging with each other are coupled to the second arm 252. The gears 5 and 6 engage with the gear 4. When the feed roller 140 is rotated in a direction F2 opposite to a paper feed direction F1, the swing bracket 250 is rotated in a direction G1 so that the gear 5 engages with a gear 8. When the feed roller 140 is rotated in the paper feed direction F1, the swing bracket 250 is rotated in a direction G2 so that the gear 7 engages with the gear 8. The gear 8 engages with a gear 9 coupled to an end of the drive roller 130.

FIG. 7 is a detailed diagram of the second gear train 220. A gear 10 is coupled to the pickup shaft 200. The pickup arm 240 is rotatably installed to the pickup shaft 200. The pickup roller 120 is installed at an end of the pickup arm 240. A gear 13 coupled to the pickup roller 120 is connected to the gear 10 through gears 11 and 12. When the feed roller 140 rotates in the direction F2, the pickup arm 240 is rotated in a direction H1 so that the pickup roller 120 is pressed on the stack of papers P and picks up a paper P. When the feed roller 140 is rotated in the direction F1, the pickup arm 240 is rotated in a direction H2 so that the pickup roller 120 is separated from the stack of papers P.

Figure 8:
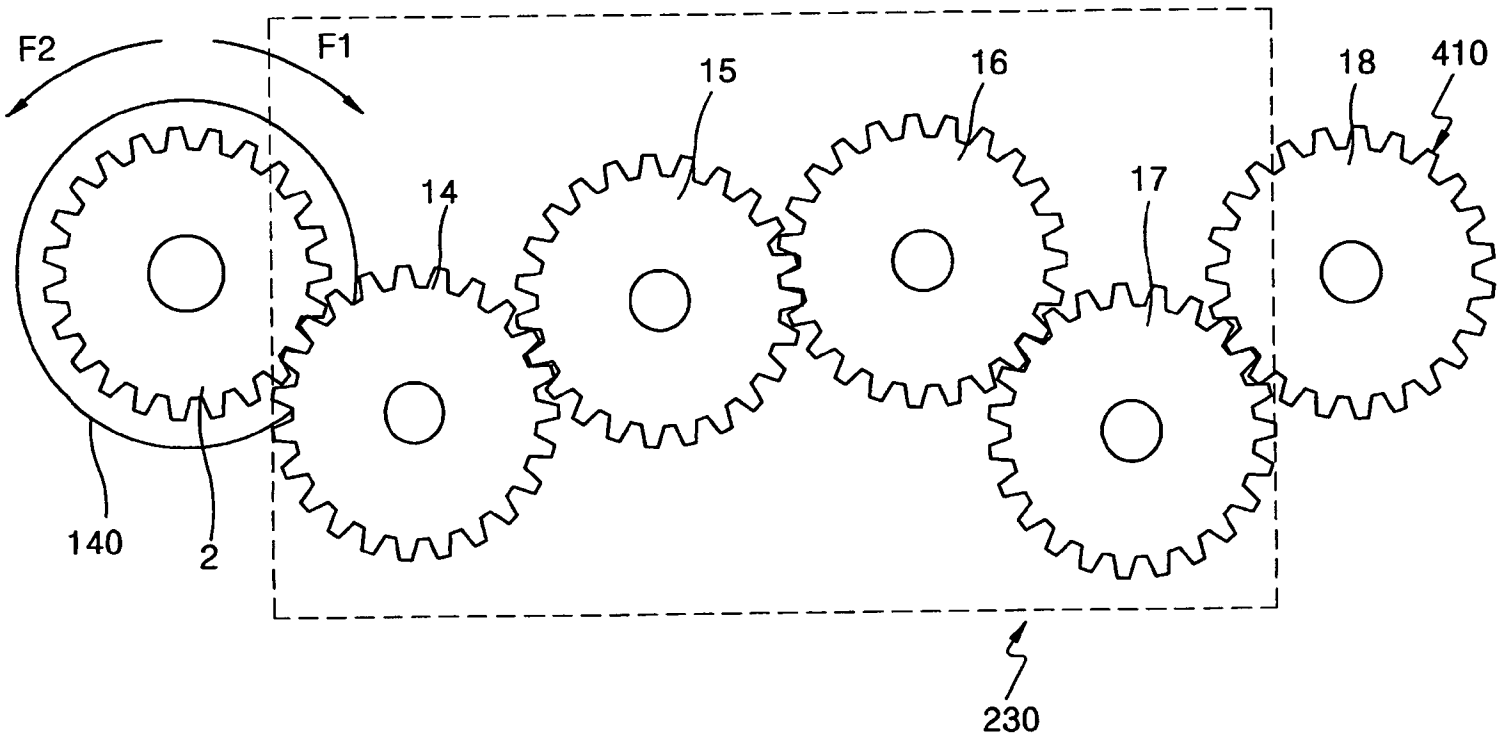
FIG. 8 is a detailed diagram of a third gear train according to the embodiment of FIG. 5.

FIG. 8 is a detailed diagram of the third gear train 230. Referring to FIG. 8, a gear 14 engages with the switching gear 2 positioned at the second place. Gears 15, 16, and 17 are sequentially connected to the gear 14. The gear 17 engages with a gear portion 18 of the rotating element 410.

Figure 9:
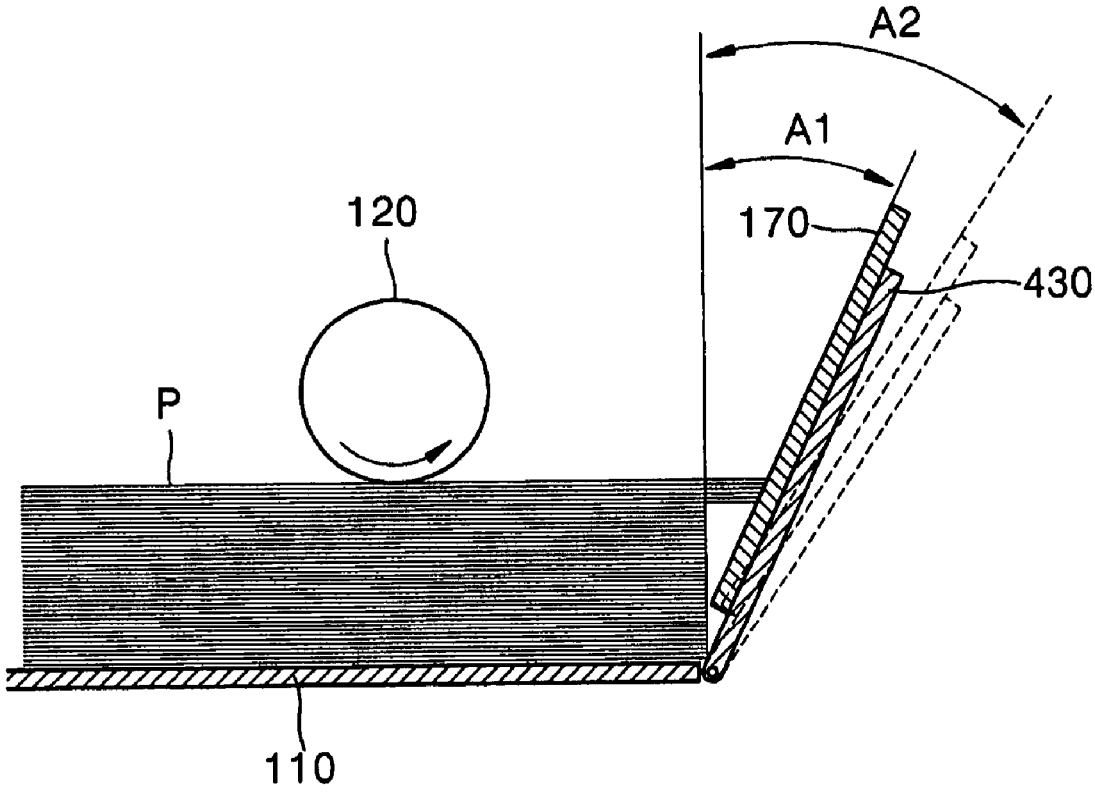
FIG. 9 illustrates inclination angles of a resistance element according to an embodiment of the present invention.

As shown in FIG. 9, an inkjet printer according to an embodiment of the present invention is characterized by a resistance element 170 whose inclination angle with respect to a front end of a paper P may be changed when the paper P is picked up. In the embodiment shown in FIG. 9, the resistance element 170 is installed on a support element 430 that may be rotated so that an inclination angle of the resistance element 170 is changed. Usually, a plain piece of paper, having a thickness of less than about 100 μm, may be separated from another paper at an angle, which is less inclined than an angle required to pick up a piece of paper having a thickness of more than about 100 μm.

Figure 10:
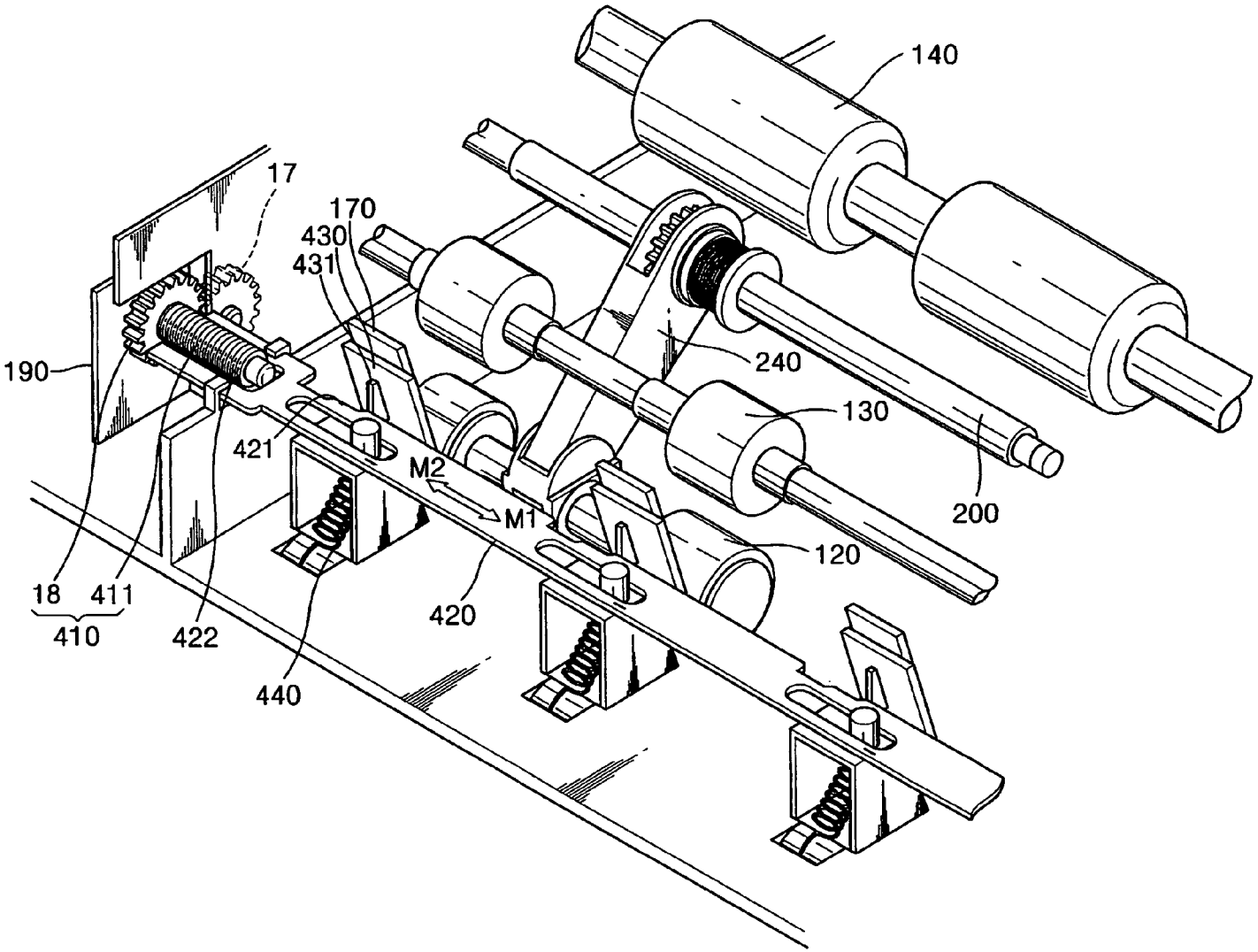
FIG. 10 is a perspective view of an angle conversion unit, which converts the inclination angle of the resistance element, according to an embodiment of the present invention.
Figure 11:
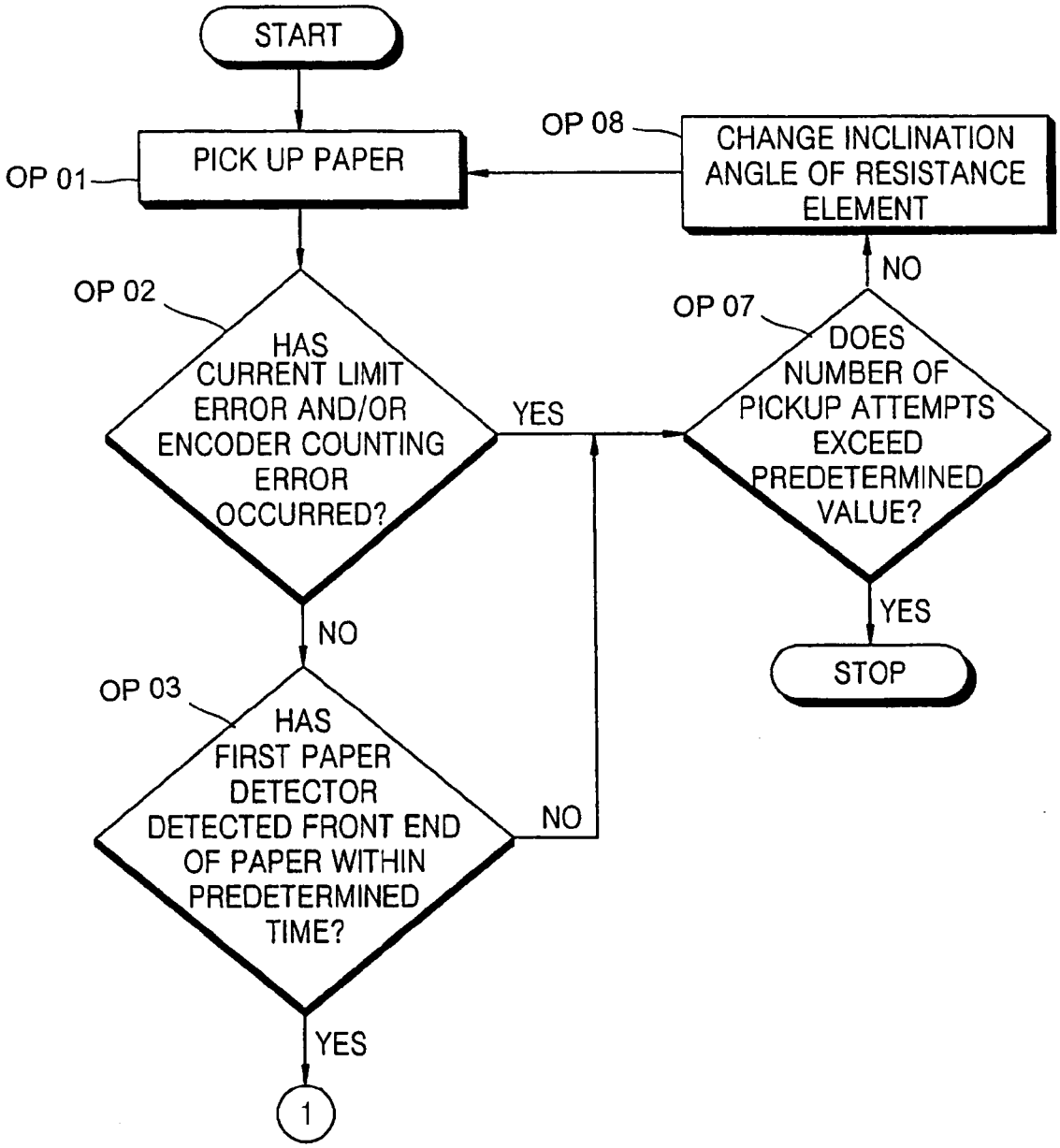
FIG. 11 is a flowchart of a paper feed method for an inkjet printer, according to an embodiment of the present invention.

FIG. 10 illustrates an angle conversion unit which converts an inclination angle of the resistance element 170 shown in FIG. 9, according to an embodiment of the present invention. Referring to FIG. 10, a rotating element 410, a sliding element 420, and a plurality of support elements 430 are shown. The rotating element 410 includes a gear portion 18 and a screw portion 411. The screw portion 411 and the gear portion 18 may be integrally formed, or the screw portion 411 may be separately formed and then coupled to the gear portion 18. The sliding element 420 includes a slope portion 421. An internal screw 422 coupled with the screw 411 is provided at an end of the sliding element 420. The sliding element 420 slides in a direction M1 or M2 according to a rotating direction of the rotating element 410. The resistance element 170 is installed on each of the support elements 430. An interference portion 431 interfering with the slope portion 421 is provided on a back of each support element 430. A tension spring 440 is installed on the back of each support element 430. The tension spring 440 elastically biases the support element 430 so that the support element 430 is rotated at a second inclination angle A2 shown in FIG. 9.

A paper feed method for an inkjet printer according to an embodiment of the present invention will be described with reference to FIGS. 1, 4–10, and 11.

Upon receiving a print command from a host (not shown), the driving motor 180 rotates the feed roller 140 in the direction F2 to pick up a paper P from the cassette 110. The switching gear 2 is elastically biased by the compression spring 145 to be positioned at the first place where the switching gear 2 engages with the gear 3. Accordingly, the driving motor 180 drives the first and second gear trains 210 and 220. Then, as shown in FIG. 7, the pickup arm 240 is rotated in the direction H1, and thus the pickup roller 120 rotates in contact with the paper P in the cassette 110 in operation OP01. Here, as shown in FIG. 6, the swing bracket 250 is rotated in the direction G1, thereby coupling the gear 5 to the gear 8. As a result, the drive roller 130 is rotated in an arrow direction 21 shown in FIG. 6. As the pickup roller 120 rotates, the paper P on the top of the stack of papers P in the cassette 110 is separated from an underlying paper P through the procedure denoted by C1, C2, and C3 shown in FIG. 1, picked up, and then fed to the first paper detector 91 by the drive roller 130.

When the first paper detector 91 does not detect a front end of the paper P within a predetermined time in operation OP03, that is, when a paper detection error occurs, the controller 90 determines that the paper P is blocked by the resistance element 170 since an inclination angle of the resistance element 170 is not appropriate with respect to a stiffness of the paper P. In this case, the paper P is not picked out of the cassette 110 due to a slip between the pickup roller 120 and the paper P, but the pickup roller 120 and the feed roller 140 are normally rotated, and therefore, the encoder 80 normally generates a count.

In order to change the inclination angle of the resistance element 170, the controller 90 moves the carriage 151 to push the switching lever 144 so that the switching gear 2 is moved to the second place. Then, the switching gear 2 is connected to the third gear train 230 so that the driving motor 180 drives the rotating element 410. As the rotating element 410 rotates, the sliding element 420 slides in the direction M1 or M2. As a result, the inclination angle of the support element 430 is changed due to interference between slope portions 421 and interference portions 431 in operation OP08. Generally, when the inclination angle of the resistance element 170 is too small, the slip occurs between the pickup roller 120 and the paper P. Accordingly, in an embodiment of the invention, the inclination angle (e.g., A2) of the resistance element 170 after the change is greater than the inclination angle (e.g., A1) thereof before the change.

The controller 90 rotates the rotating element 410 in a direction that allows the resistance element 170 to have a greater inclination angle. Here, since the feed roller 140 is also rotated, how much an initial inclination angle of the resistance element 170 is increased may be detected by checking a number of counts of the encoder 80. When changing the inclination angle of the resistance element 170, the resistance element 170 is controlled to have a minimum or maximum inclination angle, and then a difference between the maximum or minimum inclination angle and a desired inclination angle is converted into a number of counts generated by the encoder 80. Next, the rotating element 410 is rotated until the count value obtained through the conversion is encountered to change the inclination angle of the resistance element 170 into the desired inclination angle.

When the paper P is blocked by the resistance element 170 since an inclination angle of the resistance element 170 is not appropriate with respect to the stiffness of the paper P, as shown in FIG. 7, the pickup arm 240 has a tendency to rotate in the direction H1, and therefore, the pickup roller 120 strongly presses the top of the stack of the papers P. Accordingly, a load of the driving motor 180 increases, and consequently, the driving motor 180 may stall. As the load of the driving motor 180 increases, driving current of the driving motor 180 also increases. When the driving current exceeds a predetermined limit, that is, when a current limit error occurs, the driving motor 180 becomes stalled. Then, the pickup roller 120 and the feed roller 140 are not rotated. In the embodiment of the present invention, the encoder 80 is installed at the feed roller 140. When a counting interval of the encoder 80 is greater than a time interval calculated using a rotation rate of the driving motor 180 and a reduction ratio in a section between the driving motor 180 and the feed roller 140, or when the encoder 80 does not generate a count for a predetermined period of time, that is, when an encoder counting error occurs, the driving motor 180 may be determined as being stalled.

As is described above, after a pick up operation in operation OP01 is completed, when any one of the current limit error and the encoder counting error is detected in operation OP02, the controller 90 changes the inclination angle of the resistance element 170 in operation OP05 without checking whether the first paper detector 91 detects the front end of the paper P.

After changing the inclination angle of the resistance element 170, the controller 90 moves the carriage 151 so that the switching gear 2 is moved by an elastic force of the compression spring 145 to the first place where the switching gear 2 is connected to the first and second gear trains 210 and 220. Then, the driving motor 180 is rotated to rotate the pickup roller 120 to pick up the paper P. In this time, since the inclination angle of the resistance element 170 is greater than the initial inclination angle thereof, a resistance to the front end of the paper P decreases. Accordingly, a thick paper having a large stiffness may be picked up and fed through the procedure denoted by C1, C2, and C3 shown in FIG. 1. If the first paper detector 91 does not detect the front end of the paper P within the predetermined time, or if any one of the current limit error and the encoder counting error occurs, the inclination angle of the resistance element 170 is increasingly changed again, and then a pickup is re-attempted. When the number of pickup attempts exceeds a predetermined value in operation OP07, the controller 90 stops feeding the paper P.

Conventionally, since the inclination angle of the resistance element 170 is fixed to be suitable for plain papers, thick papers having a large stiffness may cause pickup errors. As described before, double feeding may occur since the thick papers are not smoothly separated from one another, or a paper feed may not be performed due to a point resistance that is too large in rotation to the thick papers. However, in an inkjet printer and a paper feed method therefor according to the present invention, during a paper pickup operation, a paper detection error, a current limit error, and an encoder counting error are detected, and the inclination angle of the resistance element 170 is changed to be suitable in relation to the stiffness of a paper to decrease a paper pickup error.

In another embodiment of the present invention, before initially picking up a paper, the inclination angle of the resistance element 170 may be adjusted according to paper information transmitted from a printer drive included in a host computer (not shown). In other words, upon receiving a type of papers P stacked in the cassette 110 from the host computer, the controller 90 rotates the rotating element 410 so that the inclination angle of the resistance element 170 is adjusted to be suitable to separate a single paper P from the stack of the papers P. When using this method of the present invention, a paper pickup error may be remarkably decreased.

When the first paper detector 91 detects the front end of the paper P within the predetermined time in operation OP03, the controller 90 determines that the paper pickup operation has been performed successfully. Thereafter, the front end of the paper P is aligned with the feed roller 140 and the print head 150, sequentially. This alignment is referred to as registration.

Figure 12:
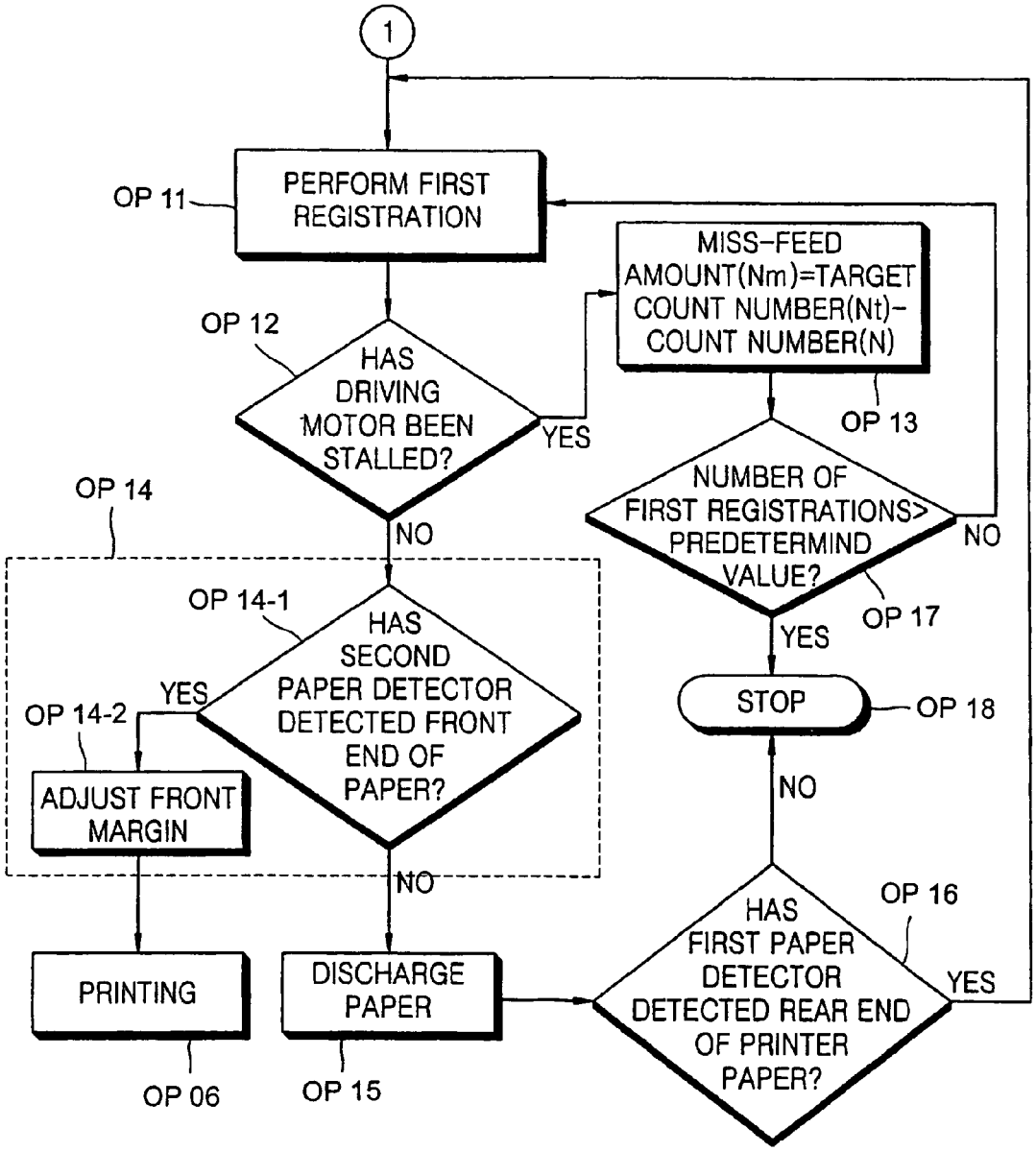
FIG. 12 is a flowchart of registration of a paper according to an embodiment of the present invention.
Figure 13:
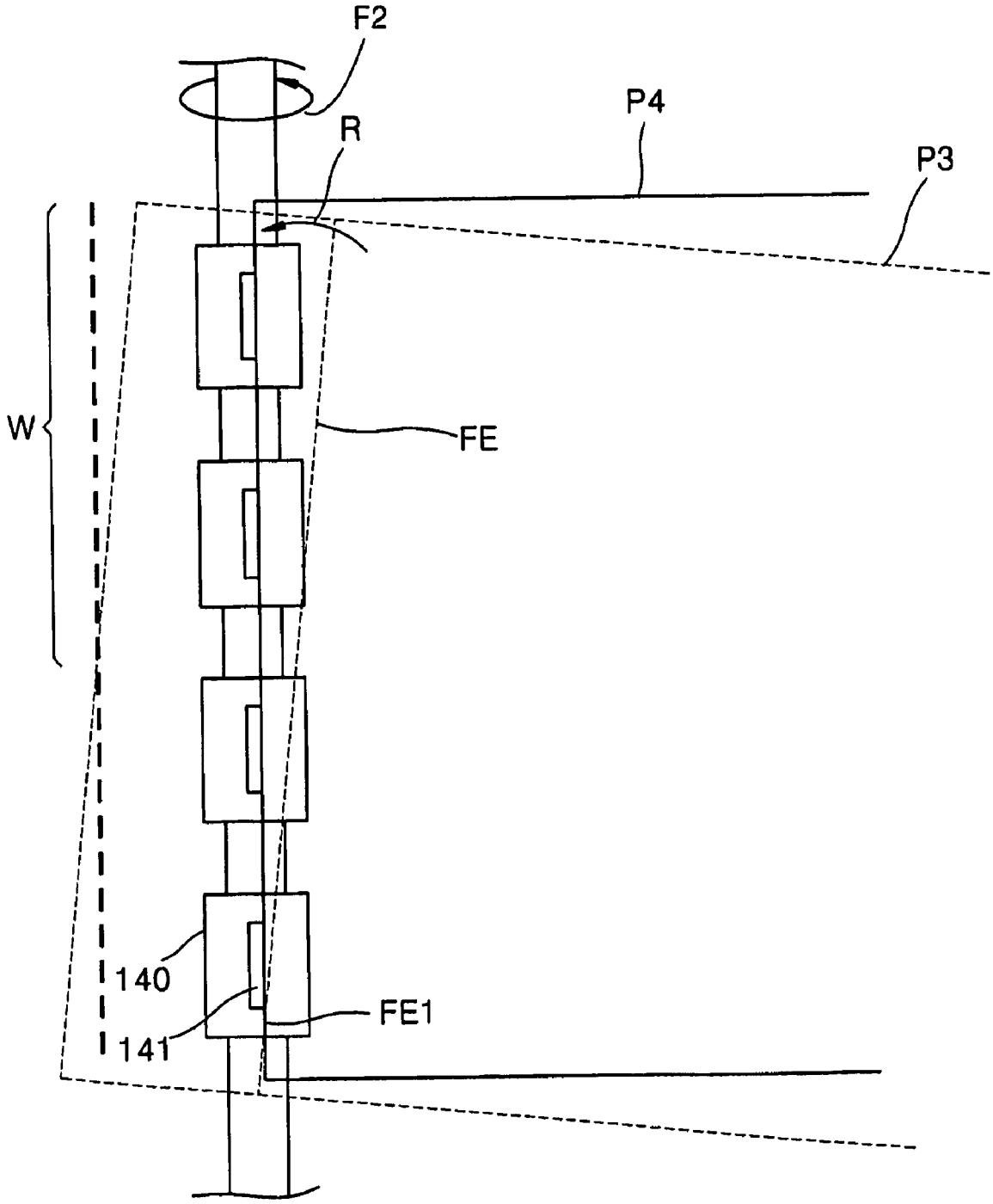
FIG. 13 illustrates a first registration according to an embodiment of the present invention.
Figure 14:
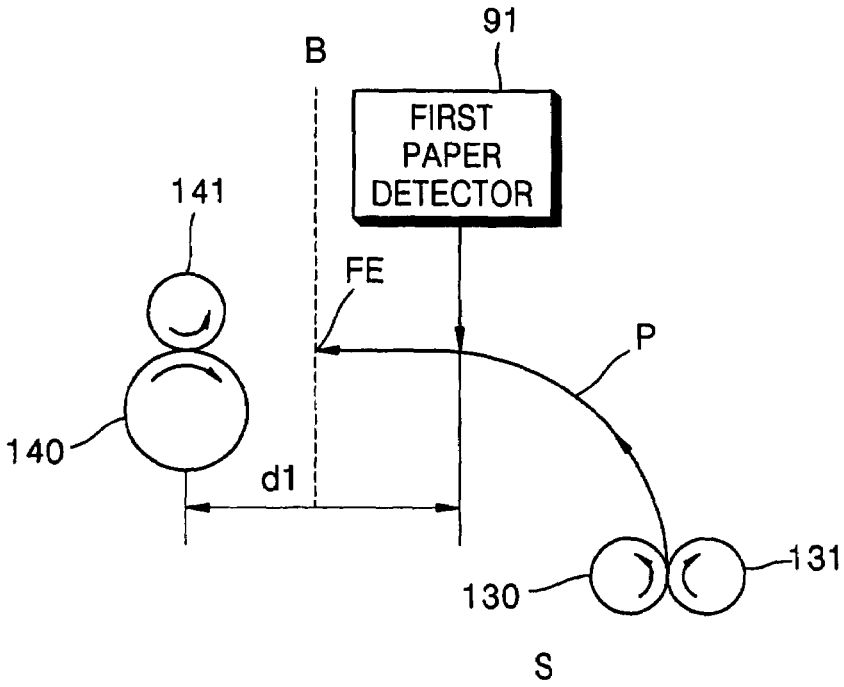
FIGS. 14 and 15 illustrate a first error and a second error, respectively.
Figure 15:
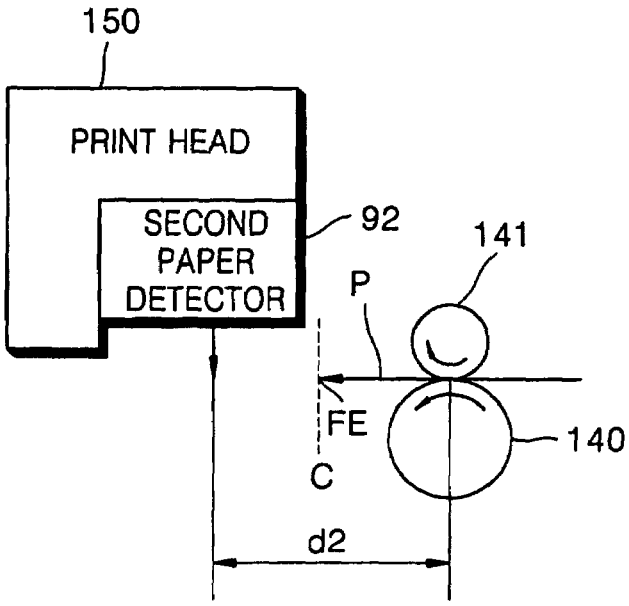

Registration, according to an embodiment of the present invention, includes a first registration to align a front end of a paper P with the feed roller 140 and a second registration to align the front end of the paper P with the print head 150. FIG. 12 is a flowchart of the registration. FIG. 13 illustrates the first registration. FIGS. 14 and 15 illustrate a first error and a second error, respectively. Hereinafter, the registration will be described with reference to FIGS. 4 and 12 through 15.

A paper P picked up by the pickup roller 120 is moved to the feed roller 140 via the drive roller 130. Referring to FIG. 13, when a skew occurs while the paper P is moved from the pickup roller 120 to the feed roller 140 via the drive roller 130, an end portion FE1 of a front end FE of the paper P may arrive first at the feed roller 140, as illustrated by a dotted position P3. If the paper P is fed by the feed roller 140 in the dotted position P3, a paper jam may occur. Even if an image is printed onto the paper P without a paper jam, some of the ink (W shown in FIG. 13) ejected from the print head 150 fails to reach the paper P, resulting in a poor printing.

In order to prevent a paper jam and poor printing due to a skew of the paper P, the first registration to align the paper P with the feed roller 140 is performed when the front end FE of the paper P is detected by the first paper detector 91 (for example, the first paper detector 91 is "ON") in operation OP11. During the first registration, since the feed roller 140 is rotated in the direction F2 opposite to the paper feed direction, the paper P is not passed through the feed roller 140 even when the end portion FE1 of the front end FE of the paper P in the dotted position P1 with a skew is in contact with the feed roller 140. In this situation, the pickup roller 120 and the drive roller 130 are continuously rotated so that the end portion FE1 first reaching the feed roller 140 is slightly curved, as illustrated by a dotted curve shown in FIG. 4, while an opposite end portion is continuously moved until reaching the feed roller 140. Accordingly, the paper P is rotated in a direction R shown in FIG. 13 around the end portion FE1 first reaching the feed roller 140. Then, the paper P is aligned with the feed roller 140, as illustrated by a solid position P4 in FIG. 13, in operation OP11.

As is described above, in order to align the paper P with the feed roller 140, the pickup roller 120 and the drive roller 130 move the paper P by a first registration value after the front end FE of the paper P is detected by the first paper detector 91. In an embodiment of the invention, the front end portion of the paper is slightly curved, as illustrated by the dotted curve in FIG. 4, with the front end FE of the paper P being in contact with the feed roller 140 when the first registration is completed. Accordingly, in an embodiment of the invention, the first registration value is slightly greater than a distance d1 (FIG. 14) between the first paper detector 91 and the feed roller 140.

When the driving motor 180 is burdened with an excessive load during the first registration, the driving motor 180 may be stalled. As a thickness of the paper P increases, a load onto the driving motor 180 also increases. In particular, when a paper feed path from the cassette 110 to the feed roller 140 has a U-shape as shown in FIG. 4, a resistance due to the stiffness of the paper P increases, and therefore, a load onto the driving motor 180 also increases. In addition, with a recent trend to slim printers, a height H between the cassette 110 and the feed roller 140 has been decreased. As a result, a load onto the driving motor 180 due to the stiffness of the paper P and the U-shape paper feed path is more increased. The driving motor 180 may also be stalled when accordion jam occurs while the paper P is fed to the feed roller 140. When the driving motor 180 is stalled during the first registration, the front end FE of the paper P stops at a dotted line B shown in FIG. 14 and does not reach the feed roller 140, or the paper P is put into the dotted position P3 shown in FIG. 13 even through the front end FE of the paper P reaches the feed roller 140. Accordingly, when paper feeding and printing is performed without correcting a registration error (referred to a first error) occurring during the first registration, poor printing or a paper jam may occur as described above with reference to FIG. 13. To overcome this problem, in an embodiment of the present invention, whether the driving motor 180 has been stalled during the first registration is determined in operation OP12.

An increase in a load onto the driving motor 180 results in an increase in driving current of the driving motor 180. When the driving current exceeds a predetermined limit, i.e., a limit current value, the driving motor 180 is stalled. Accordingly, the stall or non-stall of the driving motor 180 may be determined by monitoring the driving current of the driving motor 180 that is detected by the current detector 70.

In addition, the stall or non-stall of the driving motor 180 may be determined by monitoring a number of counts generated by the encoder 80, hereinafter referred to as a count number N. The encoder 80 generates a count proportional to a rotation amount of the feed roller 140. Since the feed roller 140 and the pickup roller 120 are rotated by the driving motor 180, the count number N reflects the rotation amount of the pickup roller 120. When the driving motor 180 is stalled, the encoder 80 does not generate a count since the feed roller 140 and the pickup roller 120 are not rotated. Accordingly, when an encoder count error occurs since a counting interval exceeds a predetermined time interval, the stall of the driving motor 180 may be determined. In addition, when an encoder count error occurs since the encoder 80 does not generate a count of a predetermined period of time, the stall of the driving motor 180 may be determined.

Also, the stall or non-stall of the driving motor 180 may be determined by driving the driving motor 180 during a first registration time T1 after the first paper detector 91 detects the front end FE of the paper P and then checking whether the count number N obtained during the first registration time T1 reaches a target count number Nt corresponding to a first registration amount dr. When the count number N is less than the target count number Nt, the driving motor 180 may be determined as being stalled. A theoretical first registration time may be calculated according to Formula (1) using the first registration amount dr, a number M of rotations of the driving motor 180 per unit time, a reduction ratio Rr1 of gears from the driving motor 180 to the pickup roller 120, and a diameter D1 of the pickup roller 120. In an embodiment of the invention, the first registration time T1 is set to be equal to or slightly greater than the theoretical time calculated using Formula (1).

$$\frac{dr}{M \times \pi \times D1 \times Rr1} \tag{1}$$

When the stall of the driving motor 180 is detected, a paper jam or the first error due to a mis-feed of the paper P is determined, and a paper feeding operation may be stopped. In an embodiment of the present invention, when the stall of the driving motor 180 is detected, a first registration is further performed, that is, at least one retrial of the first registration is performed, before stopping the paper feeding operation.

If the stall of the driving motor 180 is detected, a mis-feed amount Nm of the paper P is calculated by subtracting the current count number N from the target count number Nt calculated using the first registration amount dr in operation OP13. Then, the paper P is moved by the mis-feed amount Nm. Meanwhile, whether the driving motor 180 is stalled is newly determined. If the stall of the driving motor 180 is continuously detected while operations OP11 through OP13 are repeated a predetermined number of times, that is, when a number of first registrations exceeds a predetermined value in operation OP17, a paper feeding operation is stopped. When the stall of the driving motor 180 is not detected, completion of the first registration is determined.

As is described above, when detection of the first error is performed, poor printing due to paper skew may be prevented. In addition, paper feed errors can be reduced by repeating the first registration to correct the first error. Usually, when printing is stopped due to a paper feed error, a user's manual operation is needed to remove the paper feed error. However, according to the present invention, a paper feed error such as the first error which can be corrected without a user's manual operation is removed by repeating the first registration so that the user's convenience can be improved.

After completion of the first registration, the driving motor 180 rotates the feed roller 140 in the paper feed direction, i.e., the direction F1 so that the paper P passes between the feed roller 140 and the driven roller 141 and is thus fed in operation OP5. Here, as shown in FIG. 6, the swing bracket 250 is rotated in the direction G2 so that the gear 5 is separated from the gear 8 and the gear 7 is coupled to the gear 8. Accordingly, the drive roller 130 is continuously rotated in the arrow direction 21. Meanwhile, referring to FIG. 7, the pickup arm 240 is rotated in the direction H2 so that the pickup roller 120 is separated from the stack of the papers P. When the pickup roller 120 is separated from the stack of the papers P after completion of a paper pickup, a load onto the driving motor 180 may be reduced.

After completion of the first registration, a second registration is performed in operation OP14. After the first registration, the feed roller 140 feeds the paper P. Thereafter, whether the second paper detector 92 has detected the front end FE of the paper P (for example, the second paper detector 92 is "ON") within a second registration time T2 is determined in operation OP14-1. When the front end FE of the paper P is determined to have been detected by the second paper detector 92 within the second registration time T2, the controller 90 waits for a predetermined period of time until a front margin of the paper P, having reached below the print head 150, is adjusted and then transmits a print start command to the print head 150 in operation OP14-2. Next, the print head 150 ejects ink so that an image is printed onto the paper P in operation OP6.

When the front end FE of the paper P is determined to have not been detected by the second paper detector 92 within the second registration time T2 since the completion of the first registration, that is, when the front end FE of the paper P just reaches a dotted line C shown in FIG. 15 and does not reach below the second paper detector 92 in the second registration time T2, it may be determined that a second error occurred due to the stall of the driving motor 180 or a slip between the feed roller 140 and the paper P. A theoretical second registration time may be calculated according to Formula (2) using a distance d2 between the feed roller 140 and the second paper detector 92, the rotation rate M of the driving motor 180, a reduction ratio Rr2 of gears from the driving motor 180 to the feed roller 140, and a diameter D2 of the feed roller 140.

$$\frac{d2}{M \times \pi \times D2 \times Rr2} \tag{2}$$

In an embodiment of the invention, the second registration time T2 to be equal to or slightly greater than the theoretical time calculated using Formula (2). Further, the second registration time T2 is counted starting when the count number N reaches the target count number Nt for the first registration.

Where a slip occurs between the pickup roller 120 or the drive roller 130 and the paper P during the first registration, even when the front end FE of the paper P does not reach the feed roller 140 or is in the dotted position P3 shown in FIG. 13 while reaching the feed roller 140, the first error is not detected since the driving motor 180 has not been stalled. If printing is continued in this erroneous state, poor printing or a paper jam may occur, as described with reference to FIG. 13. However, in an embodiment of the present invention, when such a slip occurs, the front end FE of the paper P is not detected by the second paper detector 92 within the second registration time T2. As a result, the first error that occurred due to a slip between the pickup roller 120 or the drive roller 130 and the paper P but was not detected during the first registration may be detected during the second registration.

When it is determined that the front end FE of the paper P is determined to have not been detected by the second paper detector 92 within the second registration time T2 in operation OP14-1, the controller 90 discharges the paper P from the paper feed path in operation OP15. When a rear end of the paper P is determined to have been detected by the first paper detector 91 (for example, the first paper detector 91 is "OFF") within a predetermined period of time in operation OP16, the paper P is determined to be completely discharged, and when necessary, another paper P is picked up from the cassette 110. However, when the rear end of the paper P is determined to have not been detected by the first paper detector 91 within the predetermined period of time, a paper jam is determined to have occurred, and paper discharge is stopped in operation OP18.

As is described above, the present invention provides the following effects.

Firstly, papers can be reliably picked up and fed one by one regardless a thickness of the papers, and a paper pickup error may be reduced.

Secondly, a first error occurring due to the stall of a driving motor is detected so that poor printing due to a skew of a paper can be prevented.

Thirdly, when the first error is detected, a first registration is repeated, thereby reducing a user's inconvenience of manually handling a paper feed error.

Fourthly, a second registration is performed so that a first error due to a slip of a paper may be detected to more effectively prevent poor printing due to a skew of the paper.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An inkjet printer comprising:

a pickup roller which picks up a paper from a cassette in which a plurality of papers are stacked, the paper being on a top of the plurality of papers;

a resistance element to contact with a front end of the paper so that the paper may be separated from the plurality of papers and may be picked up from the cassette, thereafter;

a feed roller to feed the paper;

an angle conversion unit to change an inclination angle of the resistance element with respect to the front end of the paper; and a switching gear to be moved by a carriage to a first position to enable the feed roller to feed the paper and to a second position to drive the angle conversion unit.

2. The inkjet printer of claim 1, wherein the switching gear is installed at an end of the feed roller to slide to the first and second positions.

3. The inkjet printer of claim 2, wherein the switching gear is elastically biased so that the switching gear is moved to the first position, and so that the carriage is required to move the switching gear to the second position.

4. The inkjet printer of claim 1, wherein the angle conversion unit comprises:

a rotating element including a gear portion coupled to the switching gear and a screw portion coaxial with the gear portion;

a sliding element to move linearly, including a slope portion, coupled to the screw portion;

a support element to which the resistance element is installed, the support element being rotated in contact with the slope portion;

an elastic element to elastically bias the support element to a direction allowing the support element to be in contact with the slope portion.

5. A paper feed method of an inkjet printer, including a cassette to contain a stack of papers, a resistance element to separate a paper on a top of the stack of papers from the stack using a stiffness of the paper, an angle conversion unit to change an inclination angle of the resistance element with respect to a front end of the paper, a feed roller and a pickup roller to be driven by a driving motor, and an encoder to generate a count proportional to a rotation amount of the feed roller and the pickup roller, the paper feed method comprising:

picking up a paper from the cassette by rotating the pickup roller; and when the front end of the paper is not detected by a first paper detector within a predetermined time, repeating the pickup operation after changing the inclination angle of the resistance element to be greater than an initial inclination angle by driving the angle conversion unit.

6. The paper feed method of claim 5, wherein the angle conversion unit is driven by the driving motor.

7. The paper feed method of claim 6, wherein the repeating the pickup operation comprises:

moving a switching gear rotated by the driving motor from a first place to drive the pickup roller to a second place to drive the angle conversion unit by moving a carriage; and changing the inclination angle of the resistance element using the angle conversion unit.

8. The paper feed method of claim 7, wherein the changing the inclination angle comprises:

changing the inclination angle of the resistance element to a minimum inclination angle or a maximum inclination angle;

converting a difference between the maximum or minimum inclination angle and a desired inclination angle of the resistance element into a number of counts, which are generated by the encoder; and driving the angle conversion unit until a number of counts actually generated by the encoder reaches the converted number of counts.

9. The paper feed method of claim 5, further comprising changing the inclination angle of the resistance element to be suitable to the paper by driving the angle conversion unit according to paper information transmitted from a host, before picking up the paper.

10. The paper feed method of claim 5, further comprising:

performing a first registration by moving the front end of the paper by a first registration amount greater than a distance between the first paper detector and the feed roller after the front end of the paper, having been picked up from the cassette, is detected by the first paper detector, to align the front end of the paper with the feed roller; and repeating the first registration by calculating a mis-feed amount of the paper using a difference between a current number of counts generated by the encoder and a target number of counts obtained from the first registration amount and moving the paper by at least the mis-feed amount, when a first error occurs due to a stall of the driving motor during the first registration.

11. The paper feed method of claim 10, further comprising checking whether current of the driving motor exceeds the predetermined limit current value to detect the first error.

12. The paper feed method of claim 10, further comprising by checking whether a counting interval of the encoder exceeds the predetermined time interval to detect the first error.

13. The paper feed method of claim 10, further comprising stopping a paper feed operation when the first error is not corrected after the repeating the first registration.

14. The paper feed method of claim 13, wherein the first registration is repeated a plurality of times.

15. The paper feed method of claim 10, further comprising performing a second registration by detecting the front end of the paper using a second paper detector located at an output side of the feed roller and then adjusting a print start time of a printing unit, which prints an image onto the paper.

16. The paper feed method of claim 15, further comprising discharging the paper by moving the paper until a rear end of the paper is detected by the first paper detector when a second error occurs during the second registration since the front end of the paper is not detected by the second paper detector within the predetermined time.

17. The paper feed method of claim 16, further comprising stopping the paper discharge when the rear end of the paper is not detected by the first paper detector within the predetermined time.

18. A paper feed method of an inkjet printer including a cassette to contain a stack of papers, a resistance element to separate a paper on a top of the stack of papers from the stack using a stiffness of the paper, an angle conversion unit to change an inclination angle of the resistance element with respect to a front end of the paper, a feed roller and a pickup roller to be driven by a driving motor, and an encoder to generate a count proportional to a rotation amount of the feed roller and the pickup roller, the paper feed method comprising:

changing the inclination angle of the resistance element to be suitable to a paper according to paper information transmitted from a host;

picking up the paper from the cassette by rotating the pickup roller; and repeating the pickup operation after changing the inclination angle of the resistance element to be greater than an initial inclination angle by driving the angle conversion unit, when a current limit error occurs since current of the driving motor exceeds a predetermined limit current value during the pickup operation and/or when a counting error occurs since a counting interval of the encoder exceeds the predetermined time interval during the pickup operation.

19. The paper feed method of claim 18, further comprising:

performing a first registration by moving the front end of the paper by a first registration amount greater than a distance between the first paper detector and the feed roller after the front end of the paper is detected by the first paper detector to align the front end of the paper with the feed roller; and repeating the first registration by calculating a mis-feed amount of the paper using a difference between a current number of counts generated by the encoder and a target number of counts obtained from the first registration amount and moving the paper by at least the mis-feed amount, when a first error occurs due to a stall of the driving motor during the first registration.

20. The paper feed method of claim 19, further comprising:

repeating the first registration a plurality of times; and stopping a paper feed operation when the first error is not corrected after the repeating the first registration the plurality of times.

21. The paper feed method of claim 19, further comprising:

performing a second registration by detecting the front end of the paper using a second paper detector located at an output side of the feed roller and adjusting a print start time of a printing unit, which prints an image onto the paper; and discharging the paper by moving the paper until a rear end of the paper is detected by the first paper detector when a second error occurs during the second registration since the front end of the paper is not detected by the second paper detector within the predetermined time.

22. The paper feed method of claim 21, further comprising stopping the paper discharge when the rear end of the paper is not detected by the first paper detector within the predetermined time.

* * * * *